US005612177A

United States Patent [19]

Levy et al.

[11] Patent Number: 5,612,177

[45] Date of Patent: Mar. 18, 1997

[54] (111) TABULAR GRAIN EMULSIONS EXHIBITING INCREASED SPEED

[75] Inventors: David H. Levy, Rochester; Lyn M. Eshelman, Penfield; Paul D. Zimmerman, Rochester, all of N.Y.

[73] Assignee: Eastman Kodak Company, Rochester, N.Y.

[21] Appl. No.: 592,827

[22] Filed: Jan. 26, 1996

[51] Int. Cl.[6] ..... G03C 1/035

[52] U.S. Cl. ..... 430/567; 430/570; 430/581

[58] Field of Search ..... 430/567, 581, 430/570

[56] References Cited

U.S. PATENT DOCUMENTS

| | | | |
|---|---|---|---|
| 4,435,501 | 3/1984 | Maskasky | 430/434 |
| 4,471,050 | 9/1984 | Maskasky | 430/567 |
| 5,250,403 | 10/1993 | Antoniades et al. | 430/505 |
| 5,494,789 | 2/1996 | Daubendiek et al. | 430/567 |

*Primary Examiner*—Mark F. Huff
*Attorney, Agent, or Firm*—Carl O. Thomas

[57] ABSTRACT

A radiation-sensitive high bromide {111} tabular grain emulsion is disclosed in which at least 90 percent of silver halide epitaxy of an isomorphic face centered cubic crystal lattice structure containing at least 1 mole percent iodide is deposited on the {111} major faces in the form of monocrystalline terraces. Each epitaxial terrace is grown from a nucleation site along an edge of a {111} major face inwardly, with terraces overlying less than 25 percent of the {111} major faces. Surprisingly, these emulsions exhibit higher photographic speeds than those produced by growing silver halide epitaxy outwardly as protrusions from the corners or edges of the tabular grains.

10 Claims, 2 Drawing Sheets

1 μm

1 μm

1 μm

(111) TABULAR GRAIN EMULSIONS EXHIBITING INCREASED SPEED

FIELD OF THE INVENTION

The invention is directed to radiation-sensitive silver halide emulsions useful for imaging.

Definition of Terms

In referring to silver halide grains or emulsions containing two or more halides, the halides are named in order of ascending concentrations.

The term "high bromide" in referring to silver halide grains and emulsions is employed to indicate greater than 50 mole percent bromide, based on total silver forming the grains or emulsions.

The term "tabular grain" is defined as a grain having an equivalent circular diameter (ECD) that is at least twice its thickness.

The term "tabular grain emulsion" is defined as an emulsion in which at least 50 percent of total grain projected area is accounted for by tabular grains.

The term "{111} tabular" in referring to tabular grains and emulsions is employed to indicate that the tabular grains have {111} major faces.

The term "epitaxial terrace" is used to designate a monocrystalline epitaxial growth on a {111} major face of a tabular grain.

The term "epitaxy" is employed in its art recognized usage to indicate a crystalline form having its orientation controlled by that of another crystalline form serving as a substrate for its deposition.

*Research Disclosure* is published by Kenneth Mason Publications, Ltd., Dudley House, 12 North St., Emsworth, Hampshire P010 7DQ, England.

BACKGROUND

Maskasky U.S. Pat. No. 4,435,501, hereinafter referred to as Maskasky I, observed that the radiation sensitivity of high bromide {111} tabular grains can be enhanced when a site director, such as iodide ion, an aminoazaindene, or a selected spectral sensitizing dye, is adsorbed to the surfaces of the {111} tabular grains to restrict silver salt epitaxial deposition to selected sites, typically the edges and/or corners, of the tabular grains. Maskasky I in Examples 2 and 3 demonstrated that silver chloride grown epitaxially outwardly from the edges (Emulsion 2C) or outwardly from the corners (Emulsion 3B) of silver bromide {111} tabular grains produced a much higher photographic speed than silver chloride epitaxy grown randomly over the major faces of similar host tabular grains (Emulsion 2B, Emulsion 3A). By comparing Tables II (column 65) and III (column 66) it is evident that Maskasky I observed a larger speed increase when the silver chloride epitaxy was deposited as protrusions from the corners of the host tabular grains than as protrusions from the edges of the tabular grains. Maskasky I states that, in general, larger increases in sensitivity are realized as the epitaxial coverage of the major crystal faces decreases (column 21, lines 11 to 13 inclusive). Although the inclusion of minor amounts of iodide in the epitaxy is specifically contemplated (column 23, line 38), Maskasky I states that it is generally preferred as a matter of convenience that the silver salt epitaxy exhibit a higher solubility than the silver halide of the host tabular grain (column 24, lines 10 to 12 inclusive).

Maskasky U.S. Pat. No. 4,471,050, hereinafter referred to as Maskasky II, discloses that nonisomorphic silver salt can be selectively deposited on the edges of silver halide host grains without relying on a supplemental site director. The nonisomorphic silver salts include silver thiocyanate, β-phase silver iodide (which exhibits a hexagonal wurtzite crystal structure), γ-phase silver iodide (which exhibits a zinc blende crystal structure), silver phosphates (including meta- and pyro-phosphates) and silver carbonate. None of these nonisomorphic silver salts exhibits a face centered cubic crystal lattice structure of the type found in photographic silver halide—i.e., an isomorphoric face centered cubic rock salt crystal structure. In fact, speed enhancements produced by nonisomorphic silver salt epitaxy have been much smaller than those obtained by comparable isomorphic silver salt epitaxial sensitizations.

Related Patent Applications

Daubendiek et al U.S. Ser. No. 08/297,195, filed Aug. 26, 1994, commonly assigned and now allowed, hereinafter referred to as Daubendiek et al I, discloses an epitaxially and spectrally sensitized high bromide {111} tabular grain emulsion differing from those of Maskasky I in that the host tabular grains are ultrathin (<0.07 μm in thickness) and the silver halide epitaxy contains at least 10 mole percent chloride and an iodide concentration that is increased by iodide addition.

Deaton et al U.S. Ser. No. 08/451,881, commonly assigned and now allowed filed May 26, 1995, as a continuation-in-part of Daubendiek et al I, additionally requires that the ultrathin tabular grains contain less than 10 mole percent iodide and that the silver halide epitaxy include a higher iodide concentration than those portions of the host tabular grains extending between the {111} major faces and forming epitaxial junctions with the epitaxial protrusions.

SUMMARY OF THE INVENTION

Figure 1:
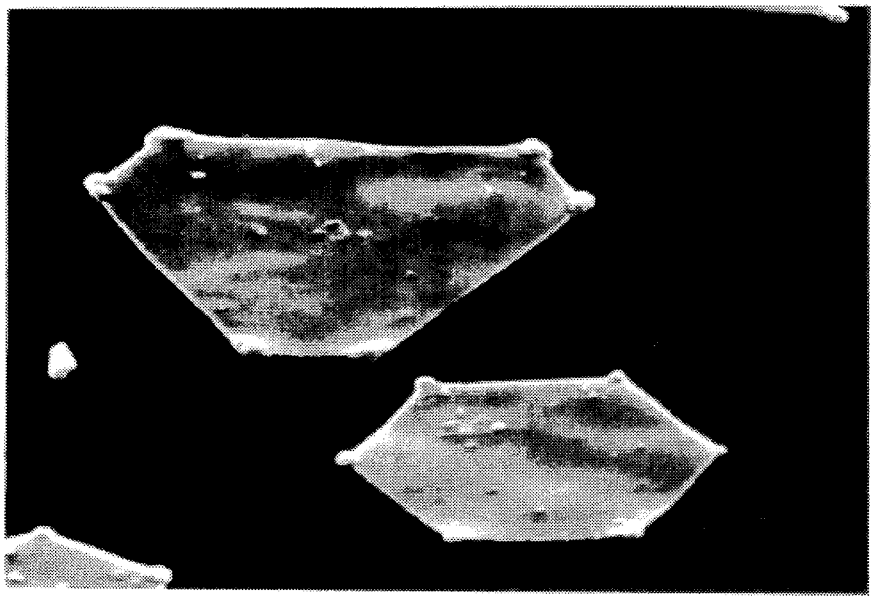
FIG. 1 (PRIOR ART)
FIG. 1 is an electron photomicrograph of conventional grain structures in which silver halide epitaxy is deposited as protrusions from the corners of host tabular grains.

In one aspect, this invention is directed to a radiation-sensitive emulsion comprised of (1) a dispersing medium, (2) silver halide grains including tabular grains (a) containing greater than 50 mole percent bromide, based on total silver, (b) accounting for greater than 50 percent of total grain projected area, and (c) having {111} major faces, and (3) silver halide epitaxy forming chemical sensitization sites on the surfaces of the tabular grains, wherein (d) the silver halide epitaxy exhibits an isomorphic face centered cubic crystal lattice structure and contains at least 1 mole percent iodide, (e) at least 90 percent of the silver halide epitaxy is deposited on the {111} major faces in the form of monocrystalline terraces, (f) each epitaxial terrace being located along and extending inwardly from an edge of a {111} major face, and (g) the epitaxial terraces overlie less than 25 percent of the {111} major faces.

From the observations of Maskasky I and II it has been generally accepted prior to the present invention that the highest levels of radiation-sensitivity attainable by epitaxially depositing a silver halide on a tabular grain host is realized by employing a site director to locate the silver halide epitaxy as protrusions from the edges or, preferably, only the corners of the host tabular grains.

Quite surprisingly it has been discovered that still higher levels of radiation sensitivity can be realized when the silver halide epitaxy is deposited as terraces grown inwardly from the edges of the host tabular grains. This has been achieved by undertaking epitaxial deposition in the absence of an adsorbed site director. By properly controlling precipitation conditions, described in detail below, the silver halide epitaxy does not deposit randomly over the major faces as Maskasky I demonstrated to occur in the absence of a site director. Thus, a novel pattern of epitaxial deposition onto tabular grains has been achieved, and the advantageous effect that it produces was not predictable from the prior teachings of the art. In fact, based on the demonstrated relative inefficiencies of random major face epitaxial depositions in sensitizing tabular grain emulsions, the observed high levels of radiation-sensitivity exhibited by the emulsions of the invention are remarkable.

Description of Preferred Embodiments

Any conventional high bromide {111} tabular grain emulsion can be employed to provide tabular grains as substrates for epitaxial deposition satisfying the requirements of the invention. Conventional high bromide {111} tabular grain emulsions are illustrated by the following, here incorporated by reference:

Abbott et al U.S. Pat. No. 4,425,425;
Abbott et al U.S. Pat. No. 4,425,426;
Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,647,528;
Sugimoto et al U.S. Pat. No. 4, 665,012;
Daubendiek et al U.S. Pat. No. 4,672,027;
Yamada et al U.S. Pat. No. 4,678,745;
Maskasky U.S. Pat. No. 4,684,60 7;
Yagi et al U.S. Pat. No. 4,686,176;
Hayashi U.S. Pat. No. 4,783,398;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Bando U.S. Pat. No. 4,839,268;
Daubendiek et al U.S. Pat. No. 4,914,014;
Aida et al U.S. Pat. No. 4,962,015;
Saitou et al U.S. Pat. No. 4,977,074;
Ikeda et al U.S. Pat. No. 4,985,350;
Piggin et al U.S. Pat. No. 5,061,609;
Piggin et al U.S. Pat. No. 5,061,616;
Takehara et al U.S. Pat. No. 5,068,173;
Nakemura et al U.S. Pat. No. 5,096,806;
Bell et al U.S. Pat. No. 5,132,203;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide tabular grain emulsions employed as substrates for epitaxial deposition include silver bromide, silver chlorobromide, silver iodobromide, silver chloroiodobromide and silver iodochlorobromide emulsions. Preferred substrate emulsions contain greater than 70 mole percent bromide, less than 10 mole percent chloride, and less than 10 mole percent iodide, each based on silver. The iodide concentration is most preferably less than 6 and optimally less than 4 mole percent, based on silver.

The tabular grains account for greater than 50 percent of total grain projected area, but preferably account for at least 70 percent and most preferably at least 90 percent of total grain projected area. In well controlled emulsion precipitations substantially all (>97%) of total grain projected area is accounted for by tabular grains.

The tabular grains of the substrate emulsions preferably exhibit a average aspect ratio of at least 5 and most preferably >8. The average aspect ratio of the tabular grains is limited only by the mean ECD of the emulsion grains, which can range to 10 μm, but is typically less than 5 μm, and the average grain thickness, which is preferably less than 0.3 μm and most preferably less than 0.2 μm. Ultrathin tabular grain substrate emulsions are specifically contemplated—that is, those in which the tabular grains have a mean thickness of less than 0.07 μm.

Employing precipitation techniques demonstrated in the Examples below, silver halide epitaxy is deposited as terraces on the substrate tabular grains. The terraces initially form on the {111} major faces of the tabular grains at their edges and then grow as monocrystalline terraces inwardly from the edges. Unlike conventional silver halide epitaxy, rather than growing outwardly from the edges of the major faces, the epitaxy is almost entirely confined to the major faces. At least 90 percent of the silver halide epitaxy is deposited On (that is, overlying) the {111} major faces. Preferably greater than 95 percent and most preferably greater than 97 percent of the silver halide epitaxy overlies the {111} major faces of the substrate tabular grains.

While the silver halide epitaxy is confined to the {111} major faces of the substrate tabular grains, it need not occupy a high percentage of their major faces. It is specifically contemplated to limit the silver halide epitaxy to less than 25 percent of the area of the {111} major faces. Preferably the silver halide epitaxy occupies less than 10 percent and, most preferably, less than 5 percent of the area of the {111} major faces. Generally any level of silver halide epitaxy that can be seen in electron micrographs to have formed terraces on the major faces of the substrate tabular grains is effective to enhance photographic performance. The silver halide epitaxy accounts usually accounts for from 0.3 to 25 (preferably 1 to 10) percent of total silver of the fully formed grains.

Both the substrate tabular grains and the silver halide epitaxy exhibit a face centered rock salt crystal lattice structure. The difference in the crystalline form of the substrate and the epitaxy lies in their crystal lattice spacings, which is in turn controlled by their halide compositions. For example, at 25° C. AgCl exhibits a lattice spacing of 5.5502 Å while AgBr exhibits a lattice spacing of 5.7748 Å. The addition of iodide to either the AgCl or AgBr lattice increases the lattice spacing, as quantitatively demonstrated by James *The Theory of the Photographic Process,* 4th Ed., Macmillan, New York, 1977, p. 4.

In the present invention it is believed that the unique placement of the silver halide epitaxy is responsible for producing an increase in speed as compared to silver halide epitaxy on the same host tabular grains, but located conventionally as protrusions from the edges and/or corners. It is believed that at least 1 mole percent iodide in the silver halide epitaxy, together with the precipitation technique demonstrated below, is necessary to achieve the unique location of the silver halide epitaxy.

Contrary to the teachings of Maskasky I, which teaches highest performance levels with silver chloride epitaxy, it has been recognized that the inclusion of iodide in the silver halide epitaxy results in superior emulsion performance. To enhance photographic speed it is preferred that the silver halide epitaxy contain a higher iodide concentration than portions of the {111} major faces with which it forms an epitaxial junction. It is well known that the incorporation of iodide in silver halide grains increases their speed. It has now been discovered that locating iodide in the silver halide epitaxy allows the speed enhancing effects of iodide to be realized with lower overall iodide concentrations. For example, 1 mole percent iodide in the silver halide epitaxy produces a larger increase in speed and requires less total iodide than incorporating 1 mole percent iodide in the substrate tabular grains.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. No. 5,238,804 and 5,288,603 (hereinafter referred to as Maskasky III and IV). Precipitation at ambient pressure, which is universally practiced in the art, limits iodide inclusion in the a silver chloride crystal lattice to less than 13 mole percent under the most favorable conditions known for iodide incorporation. Under most practical precipitation conditions much lower levels of iodide incorporation are realized. For example, introducing silver along with an 84:16 chloride:iodide molar ratio during silver halide epitaxial deposition by conventional techniques resulted in an iodide concentration in the resulting epitaxy of less than 2 mole percent, based on the silver in the epitaxy. By displacing a portion of the chloride with bromide much higher levels of iodide can be introduced into the protrusions. For example, introducing silver along with a 42:42:16 chloride-:bromide:iodide molar ratio during silver halide epitaxial deposition resulted in an iodide concentration in the resulting epitaxy of 7.1 mole percent, based on silver in the epitaxy. Preferred iodide ion concentrations in the silver halide epitaxy terraces are in the range of from 1 to 15 mole percent (most preferably 2 to 10 mole percent), based on silver forming the terraces.

While replacing chloride with bromide facilitates increased concentrations of iodide in the silver halide epitaxy, retaining chloride in the silver halide epitaxy is essential to achieving the highest levels of photographic performance. It is preferred that the chloride concentration in the silver halide epitaxy be at least 10 (most preferably at least 15 and optimally at least 20) mole percent higher than that in the substrate tabular grains.

One of the unique features of the present invention is that epitaxial deposition at the intended locations on the {111} major faces of the tabular grains is realized without employing site directors of the type disclosed by Maskasky I to be essential for realizing selective edge and/or corner epitaxial deposition.

Either or both of the tabular grains and silver halide epitaxy can contain conventional dopants. A summary of conventional dopants is provided by *Research Disclosure,* Vol. 365, September 1994, Item 36544, I. Emulsion grains and their preparation, D. Grain modifying conditions and adjustments, (3), (4) and (5). The incorporation of shallow electron trapping (SET) dopants in the substrate tabular grains and/or the silver halide epitaxy, as disclosed by *Research Disclosure,* Vol. 367, Nov. 1994, Item 36736, is specifically contemplated.

The tabular grain emulsions with silver halide epitaxy once formed can be further prepared for photographic use by any convenient conventional technique. Additional conventional features are illustrated by *Research Disclosure* Item 36544, cited above, Section II. Vehicles, vehicle extenders, vehicle-like addenda and vehicle related addenda; Section III. Emulsion washing; Section IV. Chemical sensitization; Section V. Spectral sensitization and desensitization; Section VI, UV dyes/optical brighteners/luminescent dyes; Section VII. Antifoggants and stabilizers; Section VIII. Absorbing and scattering materials; Section IX. Coating physical property modifying addenda; and Section X. Dye image formers and modifiers.

Any one of the emulsions of the invention can be coated alone onto a conventional photographic support, such as disclosed in *Research Disclosure,* Item 36544, cited above, Section XV. Supports, to form a photographic element. The emulsions of the invention can be blended with other conventional emulsions and/or coated on a photographic support along with other conventional emulsion layers. Such arrangements are illustrated by *Research Disclosure,* Item 36544, cited above, Section I. Emulsion grains and their precipitation, E. Blends, layers and performance categories. A plurality of layers containing one or more emulsions according to the invention can be incorporated into a single photographic element. Illustrations of photographic elements containing multiple emulsion layers compatible with incorporation of one or more emulsions according to the invention are found in *Research Disclosure,* Item 36544, cited above, Section XI. Layers and layer arrangements; XII. Features applicable to only color negative; XIII. Features applicable only to color reversal; and XIV. Scan facilitating features.

Photographic elements containing one or more emulsions according to the invention can be exposed by any convenient conventional technique, such as illustrated by *Research Disclosure,* Item 36544, cited above, Section XVI. Exposure. The exposed photographic elements can be conventionally processed, as illustrated by *Research Disclosure,* Item 36544, cited above, Section XVIII. Chemical development systems; Section XIX. Development; and XX. Desilvering, washing, rinsing and stabilizing.

EXAMPLES

The invention can be better appreciated by reference to the following specific embodiments.

Components

Spectral sensitizing DYE-1

Anhydro-5-chloro-9-ethyl-5'-phenyl-3'-(3-sulfobutyl)-3-(3-sulfopropyl)oxacarbocyanine hydroxide, sodium salt Spectral sensitizing DYE-2

Anhydro-6,6'-dichloro-1,1'-diethyl-3,3'-bis(3-sulfopropyl)-5,5'-bis(trifluoromethyl)benzimidazole carbocyanine hydroxide, sodium salt Spectral sensitizing DYE-3

Anhydro-3,9-diethyl-3'-methylsulfonylcarbamoyl-methyl-5-phenyloxathiacarbocyanine, p-toluenesulfonate Chemical SENSITIZER-1

1,3-Dicarboxymethyl-1,3-dimethyl-2-thiourea, disodium salt monohydrate (DCT).

Chemical SENSITIZER-2

Bis(1,4,5-trimethyl-1,2,4-triazolium-3-thiolate) Gold(I) tetrafluoroborate.

COUPLER-1:

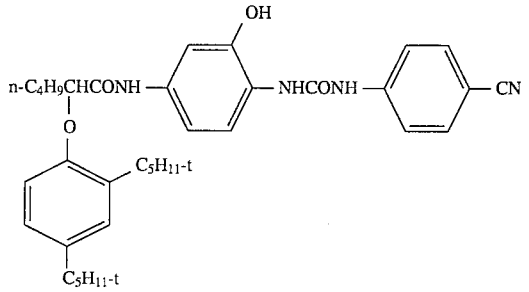

Emulsion 1 (comparison)

This emulsion demonstrates a state of the art emulsion with epitaxial sensitization. The epitaxial deposition is performed in the presence of adsorbed dye acting as a site director, resulting in epitaxial protrusions from the corners of the substrate tabular grains.

AgBrI Host Emulsion

Four liters of a solution containing 4 g/L gelatin and 7 g/L NaBr were heated to 60° C. A solution of $AgNO_3$ was run in at 27 mmol/min for 0.1 min, at which point the molar flow rate of $AgNO_3$ was changed to 1.36 mmol/min. The kettle temperature was increased to 75° C over 7.5 minutes, followed by the addition of 200 cc of 0.185M $NH_4OH$. After 5 additional minutes, the silver flow is stopped. The kettle temperature was then lowered to 60° C. over 7.5 minutes, during which time the kettle pH was lowered to approximately 5.5 and 4 L of a 25 g/L gel solution containing 3 g of NaBr were added. Silver and silver iodide seed (Lippmann) additions were then made at the rates listed in Table I. Flow rates were ramped linearly with time, and the pBr of the kettle contents was maintained at 1.5 by controlled addition of a 1.248M NaBr solution. The emulsion was then desalted and adjusted to a pBr of 3.36.

The host tabular grain emulsion exhibited a mean grain ECD of 5.2 pm and a mean grain thickness of 0.062 μm. Tabular grains accounted for substantially all of the total grain projected area. The iodide content of the host tabular grain emulsion was 2.75 percent, based on silver.

TABLE I

| Step | Time (min) | Silver flow (mmol/min) Start | Silver flow (mmol/min) Finish | AgI Seed Flow (mmol/min) Start | AgI Seed Flow (mmol/min) Finish |
|---|---|---|---|---|---|
| G1 | 25 | 3.04 | 12.5 | 0.096 | 0.37 |
| G2 | 55 | 12.4 | 47.9 | 0.37 | 1.42 |
| G3 | 30 | 47.9 | 77.7 | 1.42 | 2.33 |
| G4 | 5 | 37.4 | 37.4 | 0 | 0 |

Epitaxial Deposition

One mole of the desalted emulsion was held at 40° C., during which time equal volume additions of 0.05M $AgNO_3$ and 0.006M KI were used to adjust the pBr to 4.00. A solution containing 3.53 mmol KI and one containing 14.1 mmol NaCl were added in succession. At this point, 1.05 mmol of DYE-1 was added, followed by a 15 minute hold and the addition of 0.35 mmol of DYE-2. After 20 minutes of additional hold, a solution containing 17.8 mmol NaCl, 17.8 mmol NaBr, and 7.1 μmol of $K_4Ru(CN)_6$, was added. At this point, 6.8 mmol AgI seeds were added, followed by the addition with rapid mixing of a solution containing 35.6 mmol $AgNO_3$. The molar ratio of Ci:Br:I added for epitaxial deposition was 42:42:16.

Representative grains of Emulsion 1 are shown in FIG. 1. Epitaxial deposition occurred at the corners of the host tabular grains. The growth from these corners predominantly protrudes from the grain with little surface growth.

This material was chemically sensitized to its optimum performance position using sulfur and gold sensitizers. The gold sensitizer was SENSITIZER-1, and the sulfur sensitizer was SENSITIZER-2.

Emulsion 2 (invention)

This example demonstrates a novel method of epitaxial sensitization that results in epitaxial formations that are predominantly located on the {111}major faces of the tabular grains along their edges and extending inwardly from the edges. The epitaxial deposition was done in the absence of an art recognized site director.

AgBrI Host Emulsion

The precipitation of this emulsion was identical to that of Emulsion 1 through growth step G3. At that point, a single jet addition of 19 mmol/min $AgNO_3$ was used to adjust the pBr to 3.36, and the temperature was lowered to 40° C. The emulsion exhibited a mean ECD of 5.3 μm and a mean grain thickness of 0.068 μm Tabular grains accounted for substantially all of the total grain projected area. The tabular grains contained 2.75 mole percent iodide.

Epitaxial Deposition

On a basis of one mole of host emulsion at 40° C.: Simultaneous, equal volume additions of 0.213M $AgNO_3$ and 0.017M KI were used to adjust the pBr to 4.00. A solution containing 3.45 mmol KI and 13.7 mmol NaGl was added to the reactor, followed by a 2 minute hold. Another solution containing 69.6 mmol NAGl, 17.4 mmol NaBr, and 7.0 Bmol of $K_4Ru(CN)_6$ was added followed by a 2 minute hold. AgI seeds (Lippmann) in the amount of 6.6 mmol were added to the reactor, followed at 2 minutes by the addition, with rapid mixing, of a solution containing 34.7 mmol $AgNO_3$. The molar ratio of Cl:Br:I introduced during epitaxial deposition was 42:42:16. At this point the emulsion was desalted and adjusted to a pBr of 3.36.

Figure 2:
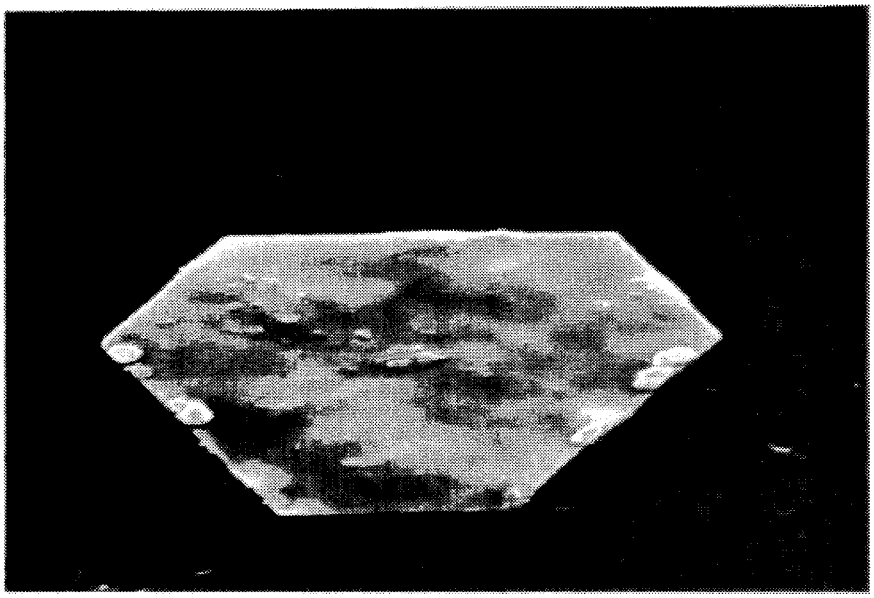
FIG. 2 is an electron photomicrograph of a grain satisfying the emulsion requirements of the invention in which silver halide epitaxy is deposited as terraces on the major surfaces, the terraces extending inwardly from the edges of the host tabular grains.

A representative grain from the emulsion is shown in FIG. 2. Notice that epitaxial deposition appears as terraces on the major face shown of the tabular grain. The terraces extend from the edges of the host tabular grain inwardly with little, if any protrusion beyond the outer boundary of the {111} major face. Samples of emulsion taken during the progress of epitaxial deposition indicate that epitaxial deposition began on the {111} major faces of the host tabular grains at their edges with growth progressing inwardly from the edges of the major faces.

The optimum sensitization of this emulsion was obtained as described above for Emulsion 1. Since dyes were not present during the epitaxial deposition, they were added prior to chemical sensitization. The material received, on a 1 mol basis, 1.03 mmol of DYE-1, followed by a 15 min hold at 40° C., and 0.17 mmol of DYE-3, followed by a hold of 20 min.

Coating and Evaluation

Emulsions 1 and 2 were identically coated in a format containing 0.75 g/m$^2$ silver, 3.2 g/m$^2$ gelatin, and 1.1 g/m$^2$ of the cyan forming COUPLER-1. The emulsion layer was overcoated with 3.2 g/m$^2$ of gelatin containing the hardening agent bis(vinylsulfonylmethyl)ether at a concentration of 1.8%, based on the weight of total coated gelatin.

Test exposures were made with a Daylight-5A light source filtered to remove blue light by a Wratten-9™ filter. Exposures were made through a 21-step density tablet to allow speed determinations after color negative processing using the Kodak Flexicolor C-41 process.

Performance is summarized in Table II.

TABLE II

| Emulsion | Dmin | Dmax | Speed |
|---|---|---|---|
| 1(cont.) | 0.10 | 1.44 | 323 |
| 2(inv.) | 0.10 | 1.15 | 356 |

The notable difference between the emulsions was the markedly higher speed exhibited by invention Emulsion 2. Speed is reported in relative log speed units. Each unit difference in relative speed represents 0.01 log E, where E represents exposure in luxseconds. Speed was measured at a toe density $D_s$, where $D_s$ minus $D_{min}$ equals 20 percent of the slope of a line drawn between $D_s$ and a point D' on the characteristic curve (plot of exposure vs. density) offset from $D_s$ by 0.6 log E.

The speed of Emulsion 2 was 33 log speed units (0.33 log E) faster than that of Emulsion 1. That is, Emulsion 2 exhibited slightly more than twice the speed of Emulsion 1. When it is considered that Emulsion 1 itself is representative of the highest speed epitaxial sensitization technique heretofore realized in the art, the large speed superiority of Emulsion 2 is both remarkable and surprising. It was entirely unexpected that relocating epitaxial deposition from corner protrusions to terraces along and inward of the edges of the (111) major faces of tabular grains would produce any speed advantage.

The invention has been described in detail with particular reference to preferred embodiments thereof, but it will be understood that variations and modifications can be effected within the spirit and scope of the invention.

What is claimed is:

1. A radiation-sensitive emulsion comprised of (1) a dispersing medium, (2) silver halide grains including tabular grains (a) containing greater than 50 mole percent bromide, based on total silver, (b) accounting for greater than 50 percent of total grain projected area, and (c) having {111} major faces, and (3) silver halide epitaxy forming chemical sensitization sites on the surfaces of the tabular grains, wherein (d) the silver halide epitaxy exhibits an isomorphic face centered cubic crystal lattice structure and contains at least 1 mole percent iodide, (e) at least 90 percent of the silver halide epitaxy is deposited on the {111} major faces in the form of monocrystalline terraces, (f) each epitaxial terrace being located along and extending inwardly from an edge of a {111} major face, and (g) the epitaxial terraces overlie less than 25 percent of the {111} major faces.

2. A radiation-sensitive emulsion according to claim 1 wherein the tabular grains contain greater than 70 mole percent bromide, less than 10 mole percent chloride, and less than 10 mole percent iodide.

3. A radiation-sensitive emulsion according to claim 2 wherein the tabular grains contain less than 6 mole percent iodide.

4. A radiation-sensitive emulsion according to claim 3 wherein the tabular grains contain less than 4 mole percent iodide.

5. A radiation-sensitive emulsion according to claim 2 wherein the tabular grains are silver iodobromide grains.

6. A radiation-sensitive emulsion according to claim 1 wherein the silver halide epitaxy contains chloride in a concentration at least 10 mole percent higher than that of the tabular grains.

7. A radiation-sensitive emulsion according to claim 1 wherein the epitaxial terraces overlie less than 10 percent of the {111} major faces.

8. A radiation-sensitive emulsion according to claim 7 wherein the epitaxial terraces overlie less than 5 percent of the {111} major faces.

9. A radiation-sensitive emulsion according to claim 1 wherein the epitaxial terraces contain from 1 to 15 mole percent iodide, based on silver.

10. A radiation-sensitive emulsion according to claim 9 wherein the epitaxial terraces contain from 2 to 10 mole percent iodide, based on silver.

* * * * *